US005233965A

United States Patent [19]

Ishikawa et al.

[11] Patent Number: 5,233,965

[45] Date of Patent: Aug. 10, 1993

[54] FUEL INJECTION QUANTITY CONTROL SYSTEM FOR STARTING A TWO-CYCLE ENGINE

[75] Inventors: Hideyuki Ishikawa, Tokyo; Tomoyuki Hirose; Yoshiki Yuzuriha, both of Isesaki, all of Japan

[73] Assignees: Fuji Heavy Industries Ltd., Tokyo; Japan Electronic Control Systems Co., Ltd., Isesaki, both of Japan

[21] Appl. No.: 793,350

[22] PCT Filed: Oct. 26, 1990

[86] PCT No.: PCT/JP90/01387

§ 371 Date: Jan. 10, 1992

§ 102(e) Date: Jan. 10, 1992

[51] Int. Cl.[5] ..... F02D 41/06

[52] U.S. Cl. ..... 123/491

[58] Field of Search ..... 123/491, 179.16, 179.17

[56] References Cited

U.S. PATENT DOCUMENTS 4,432,325 2/1984 Auracher et al. ..... 123/491
4,735,184 4/1988 Kasanami et al. ..... 123/491
4,765,300 8/1988 Fujimura et al. ..... 123/179.16
5,074,271 12/1991 Suzuki et al. ..... 123/491

FOREIGN PATENT DOCUMENTS 59-176426 10/1984 Japan ..... 123/491
60-29824 7/1985 Japan .
62-218633 9/1987 Japan .
63-189628 8/1988 Japan .
63-255543 10/1988 Japan .
64-53035 3/1989 Japan .

*Primary Examiner*—Andrew M. Dolinar
*Attorney, Agent, or Firm*—Foley & Lardner

[57] ABSTRACT

A fuel injection quantity control system for starting a two-cycle engine. The control system calculates an initial fuel injection quantity by correcting a basic fuel injection quantity according to a subtrahend to be applied to a time factor which is determined depending on a cranking time. The time factor is differently set for a first engine start operation and second or later engine start operation, thereby improving restart of the engine.

3 Claims, 7 Drawing Sheets

FUEL INJECTION QUANTITY CONTROL SYSTEM FOR STARTING A TWO-CYCLE ENGINE

DESCRIPTION

1. Technical Field

The present invention relates to a two-cycle engine, and particularly to a system of controlling a fuel injection quantity for starting.

2. Background Art

In two-cycle engines for motorcycles and snowmobiles employing a fuel supply system by means of a carburetor, an exhaust port is opened during scavenging air, therefore, some air-fuel mixture (new air) passes through a cylinder with combustion gas. Consequently, fuel consumption is increased. Accordingly, instead of such a conventional fuel supply system by means of carburetor, two-cycle engines for motorcycles and snowmobiles frequently employ a fuel supply system of electronically controlled fuel injection type using a fuel injection valve. (Refer to, for example, Japanese Unexamined Patent Publication No. 63-255543.) This sort of system provides the intake manifold of each cylinder with a fuel injection valve to simultaneously inject fuel to all cylinders.

The fuel injection quantity control for starting the two-cycle engine of electronically controlled fuel injection type is achieved as follows.

A slightly larger fuel injection quantity in starting a two-cycle engine than in normally driving the engine is set, thereby easily starting the engine.

When an ignition switch is turned to a start position for cranking the engine, a value expressed with the following equation is output.

$$T_{ILN}=T_{ILNTWK}\times K_{LN}\times K_{LT}$$

where $T_{ILN}$ is a fuel injection pulse width for starting the engine, $T_{ILNTWK}$ a basic fuel injection quantity for starting the engine, $K_{LN}$ a rotational speed factor, and $K_{LT}$ a time factor.

The basic fuel injection quantity which differs depending on engine temperature is stored in advance in a memory. The rotational speed factor changes depending on cranking speed. The time factor changes depending on cranking time.

As shown in FIG. 9, the time factor $K_{LT}$ set depending on time is updated at a predetermined interval of time (for example, 65 ms) by subtracting a predetermined value $\Delta K_{LT}$ (1at first).

Namely, the time factor $K_{LT}$ is successively updated according to $K_{LT}=K_{LT}-\Delta K_{LT}$ and decreased according to elapsing time as shown in FIG. 10.

Such a two-cycle engine shows the following problem in case the engine was started and once driven to a complete combustion state, thereafter, due to a certain reason, the engine stalled and was then restarted.

Namely, the time factor $K_{LT}$ is newly set for every starting operation, thereby setting a large time factor in correcting a fuel injection quantity for restarting the engine. As a result, the actual fuel injection quantity exceeds the required fuel injection quantity of the engine, thereby setting an air-fuel ratio to be too dense and failing in restart (FIG. 11).

In view of the problem of the conventional system, an object of the present invention is to provide a fuel injection quantity control system for starting a two-cycle engine for easily restarting the engine by setting a time factor to be suitable for cranking time in such a way that the fuel injection quantity may not exceed the required fuel injection in restarting the engine, thereby improving the starting operation of the engine.

DISCLOSURE OF THE INVENTION

To achieve the object, as shown in FIG. 1, a fuel injection quantity control system for starting a two-cycle engine according to the present invention comprising: a fuel injection valve; a means for correcting a basic injection quantity for starting the engine stored in advance in a memory depending on the engine temperature depending on cranking speed; and a means for correcting said basic fuel injection quantity depending on cranking time; provides as the means for correcting said basic fuel injection quantity depending on cranking time: a time factor setting means for updating, at predetermined intervals; a time factor by subtracting a predetermined subtrahend from a last time factor; a first subtrahend setting means for setting a first subtrahend to be applied to the time factor at a first engine start; a start judging means for judging, when an engine start is detected, whether it is a second or later engine start; and a second subtrahend setting means for setting a second subtrahend which is larger than the first subtrahend when the second or later engine start is judged by the start judging means.

In this way, the first subtrahend set by the first subtrahend setting means is selected at the first engine start and the fuel injection quantity for starting the engine is calculated. When the second or later engine start is judged, the second subtrahend set by the second subtrahend setting means is selected and the fuel injection quantity for starting the engine is calculated.

As mentioned above, even if the engine stalls due to a certain reason and is restarted after it was started and reached a complete combustion state, the invention can surely restart the engine with the actual fuel injection quantity not exceeding the required fuel injection quantity, thereby improving the starting operation of the engine.

DESCRIPTION OF THE PREFERRED EMBODIMENTS

Figure 1:
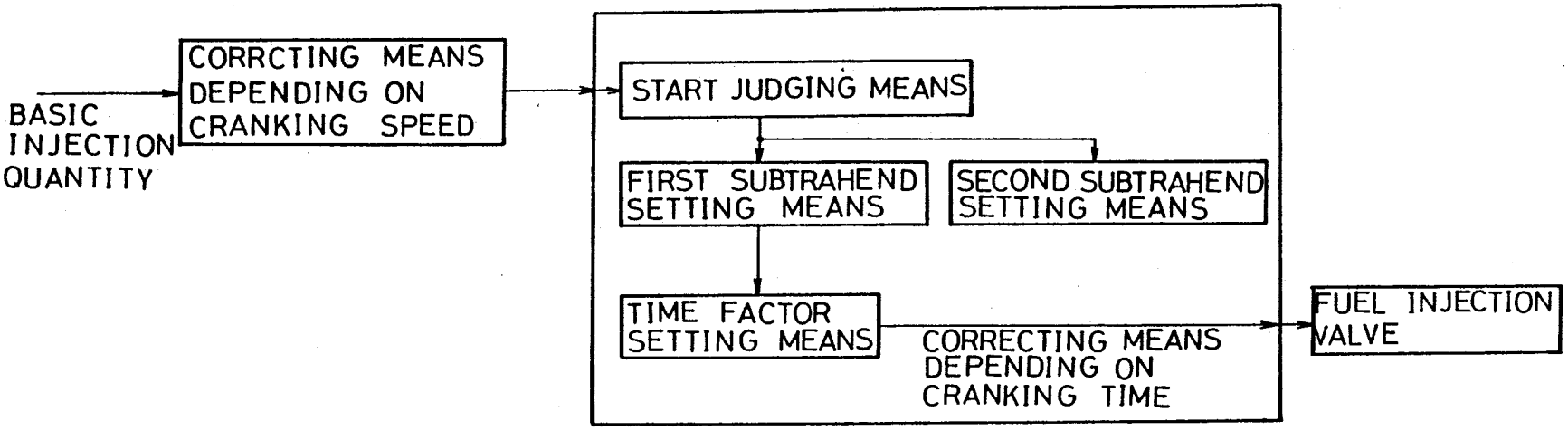
FIG. 1 is a block diagram showing the structure of the present invention.

Embodiments according to the invention will now be described referring to the drawings.

Figure 2:
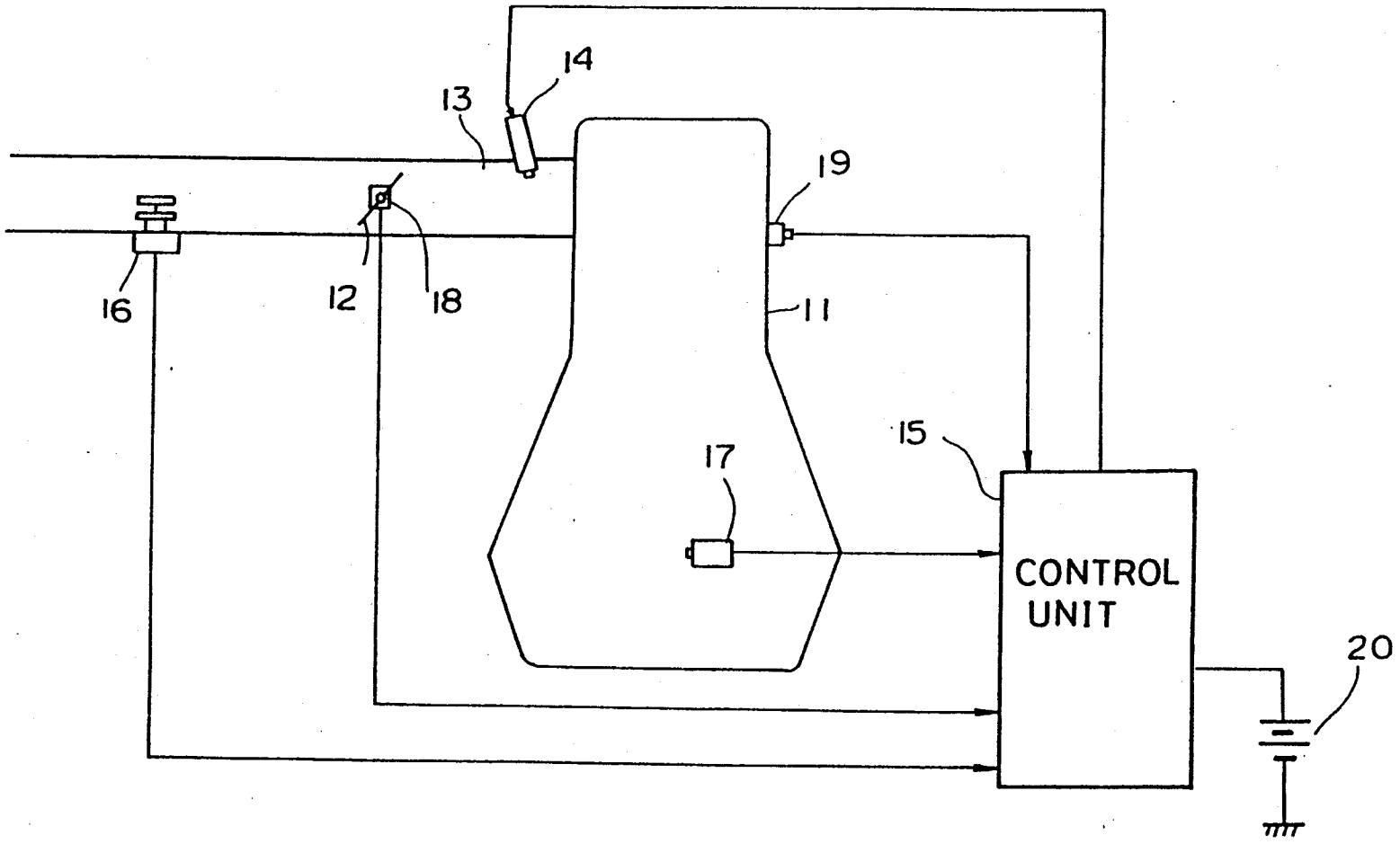
FIG. 2 is a system diagram showing an embodiment of the invention.

In FIG. 2, intake air passes an air cleaner (not shown), a throttle valve 12 interlocked with an accelerator, and an intake manifold 13, and enters a two-cycle engine 11.

The intake manifold 13 has a branch where a fuel injection valve 14 is arranged for each cylinder. The fuel injection valve 14 is solenoid type fuel injection valve having a solenoid. When the solenoid is energized, the valve opens, and when it is de-energized, the valve closes. A control unit 15 provides the solenoid with a driving pulse signal to open the valve. While the valve is open, fuel which is pressurized by a fuel pump (not shown) and adjusted to a predetermined pressure by a pressure regulator is injected into the engine 11.

The control unit 15 receives output signals from various sensors processes the input data with a built-in microcomputer, determines a fuel injection quantity (an injection time) Ti as well as injection timing (an injection process), and provides the valve 14 with the driving pulse signal.

The sensors include an airflow meter 16 upstream the throttle valve 12, which provides a signal representing an intake airflow rate Q. A distributor (not shown) incorporates an engine crank sensor 17 for outputting a reference signal every 120 degrees. By measuring a period of the reference signal, an engine speed N can be detected.

The throttle valve has a throttle sensor 18 of potentiometer type for outputting a signal representing an aperture $\alpha$. The engine 11 has a water jacket having a water temperature sensor 19. The sensor 19 serves as one example of engine temperature and outputs a signal representing a cooling water temperature Tw. In a two-cycle engine, new air is supplied to a combustion chamber through a crank case, therefore the air is directly influenced by the crank case temperature. Accordingly, the crank case temperature may be selected as the engine temperature instead of the cooling water temperature.

The control unit 15 receives a voltage from a power source battery 20 and detects a power source voltage VB.

Figure 3:
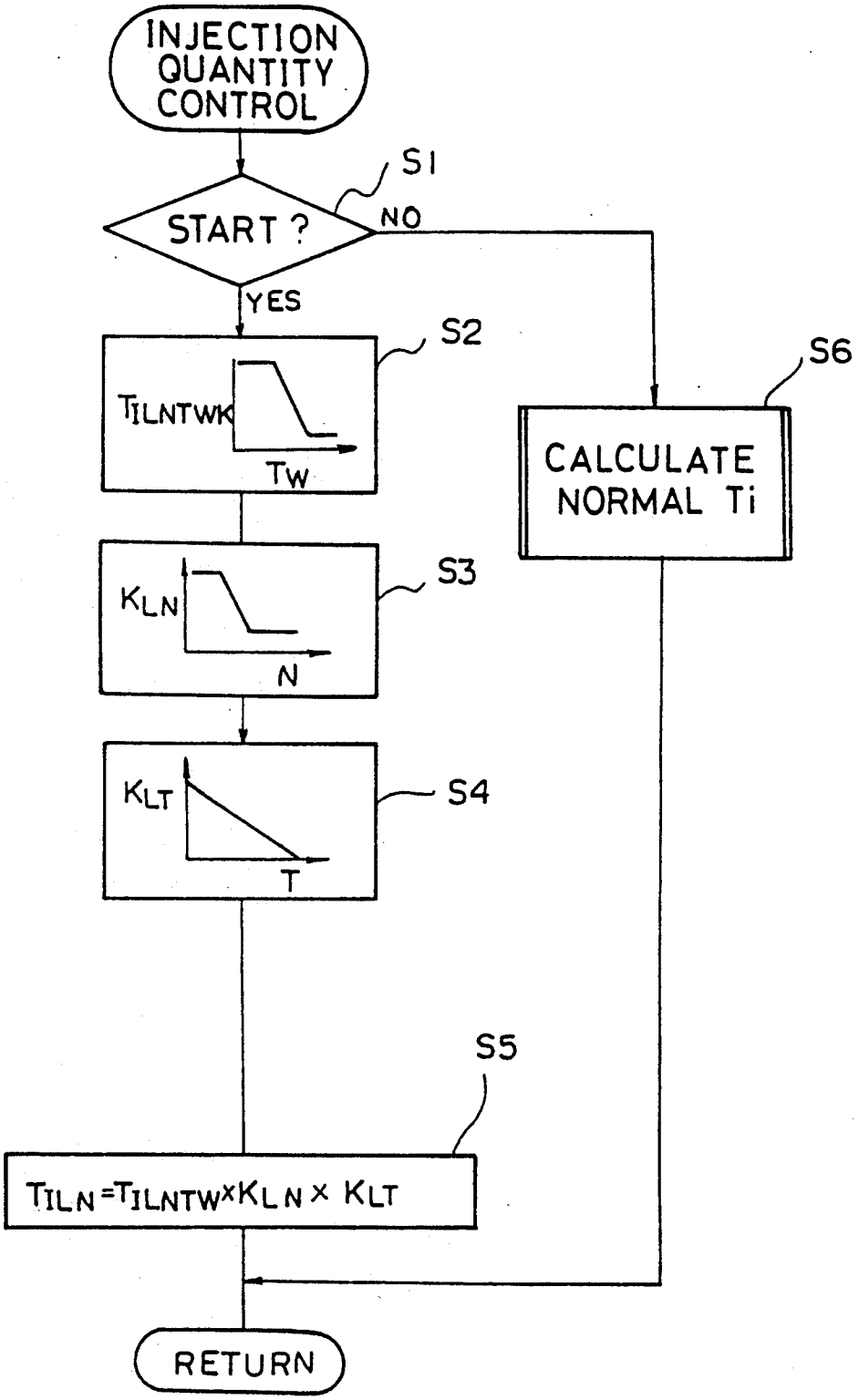
FIG. 3 is a flowchart showing fuel injection quantity control routine for starting an engine.

Fuel injection control for starting an engine carried out by the microcomputer of the control unit 15 will be explained with reference to a flowchart of FIG. 3.

In step 1 (indicated as S1 in the figure), the judging means judges whether or not it is an engine starting operation (whether or not the ignition switch is at the start position).

Figure 4:
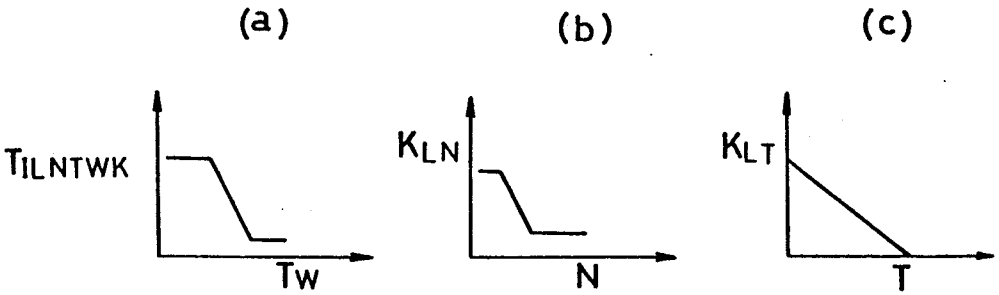
FIGS. 4(*a*) through (*c*) are characteristic diagrams showing basic fuel injection quantities for starting an engine, rotational speed factors depending on cranking speed, and time factors depending on cranking time.

If it is the engine start, the flow proceeds to step 2 in which the water temperature sensor 19 detects a cooling water temperature Tw, and according to the detected temperature, a retrieving means of the control unit 15 retrieves a basic fuel injection quantity $T_{ILNTWK}$ as shown in FIG. 4(*a*). Step 3 finds an engine speed N, and according to which, the retrieving means of the control unit 15 retrieves a rotational speed factor $K_{LN}$ as shown in FIG. 4(*b*).

Step 4 finds a time factor $K_{LT}$ according to a table map of time factors $K_{LT}$ stored in advance according to a cranking time T as shown in FIG. (*c*), and a subtrahend provided by a subtrahend setting means to be explained later.

Step 5 calculates a fuel injection pulse width $T_{ILN}$ according to the above-mentioned equation and controls the fuel injection valve 14 according to the calculated pulse width.

If it is not the engine starting operation, the flow advances from step 1 to step 6 to normally control Ti.

The control unit 15 incorporates, as a means for correcting a basic fuel injection quantity $T_{ILNTWK}$ depending on cranking time, a time factor setting means for updating and setting, at predetermined intervals, a time factor to be suitable for a cranking time by subtracting a predetermined subtrahend from a last time factor; a first subtrahend setting means for setting a first subtrahend to be applied to the time factor at a first engine start; a start judging means for judging, when the engine is started, whether it is a second or later engine start; and a second subtrahend setting means for setting a second subtrahend which is larger than the first subtrahend when the second or later engine start is judged by said start judging means.

Figure 5:
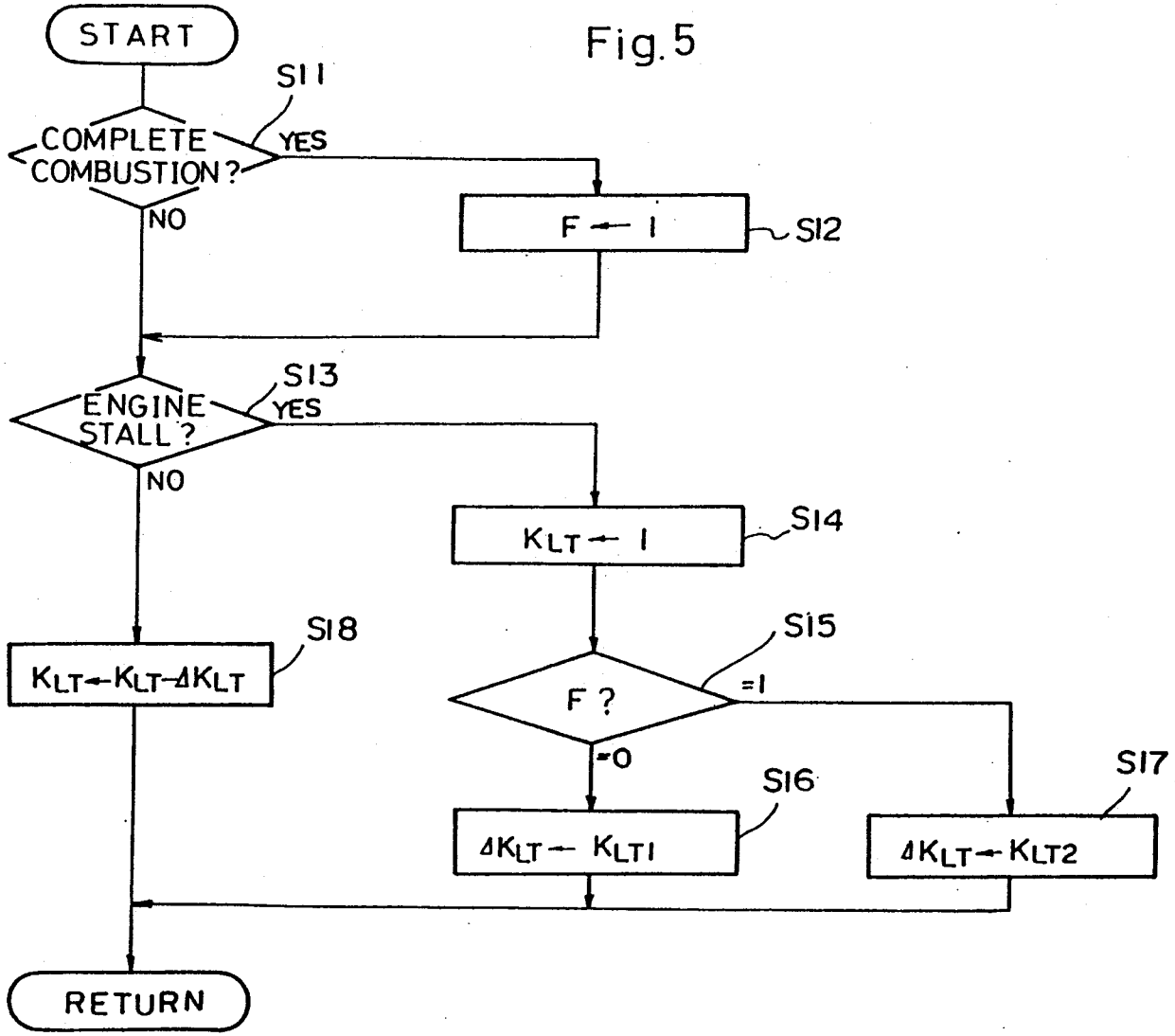
FIG. 5 is a flowchart showing time factor setting routine.

Operations of these means will be explained with reference to a time factor setting routine of FIG. 5.

Step 11 judges whether or not the engine is started for the second time or afterward by judging whether or not the engine is in a complete combustion state. This step judges whether or not a rotational speed of the engine has once exceeded a set rotational speed before starting the engine.

If the speed of the engine has once exceeded the set speed, it is judged to be a second or later engine starting operation to execute step 12, which sets a flag (F) to 1 and proceeds to step 13. If the speed of the engine has not exceeded the set rotational speed, it is judged to be a first engine starting operation, and the flow directly proceeds to step 13.

Step 13 judges whether or not the engine is in a stalled state (the engine is not operating). If the engine is in the stalled state, step 14 sets the time factor $K_{LT}$ to an initial value I, and proceeds to step 15, which judges whether or not the flag (F) is 1. If the flag (F) is not 1, the flow proceeds to step 16. Step 16 selects a first subtrahend $\Delta K_{LT1}$ as a subtrahend $\Delta K_{LT}$ to be applied to the time factor and goes to RETURN. If the flag (F) is 1, step 17 selects a second subtrahend $\Delta K_{LT2}$ which is larger than the first subtrahend $\Delta K_{LT1}$, as the subtrahend $\Delta K_{LT}$ to be applied to the time factor and goes to RETURN.

If step 13 judges that the engine is not in a stalled state, the flow proceeds to step 18 in which, at a predetermined interval of time (for example, 65 ms), the subtrahend $\Delta K_{LT}$ ($\Delta K_{LT1}$ or $\Delta K_{LT2}$) is subtracted from a last value $K_{LT}$ (initially 1), thereby updating and setting $K_{LT}$. Namely, $K_{LT}=K_{LT}-\Delta K_{LT}$ is calculated to successively update and set $K_{LT}$. Thereafter, the process goes to RETURN.

Step 16 corresponds to the first subtrahend setting means, step 17 to the second subtrahend setting means, step 11 to the start judging means for judging the second or later engine start, and step 18 to the time factor setting means.

Figure 6:
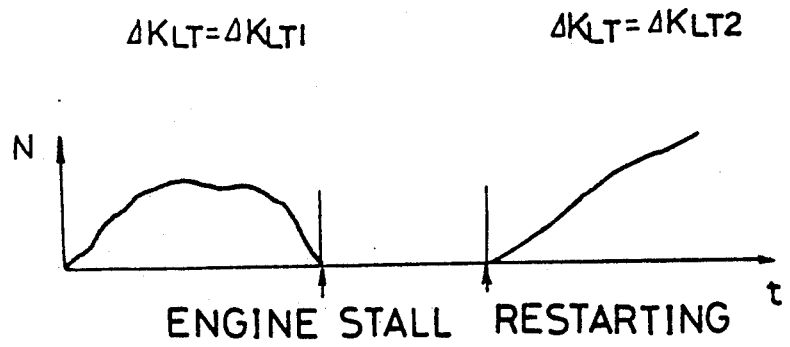
FIG. 6 is a time chart explaining effect of said embodiment.

The above arrangement has the two subtrahend setting means for setting a subtrahend to be applied to a time factor. To restart the engine, the embodiment selects a time factor $K_{LT}$ by setting the subtrahend $\Delta K_{LT2}$ which is larger than the subtrahend $\Delta K_{LT1}$ being selected for starting the engine for the first time. If the engine stalls due to a certain reason and restarts after it started and reached a complete combustion state, an actual fuel injection quantity will never exceed a required fuel injection quantity of the engine, and the restarting operation can surely drive the engine as shown in FIG. 6, thereby improving starting performance.

Another embodiment of the invention will be explained.

This embodiment determines a second subtrahend $\Delta K_{LT2}$ according to a period of time from an engine stalling in a first engine starting operation to restarting, i.e., an engine stall period.

Figure 7:
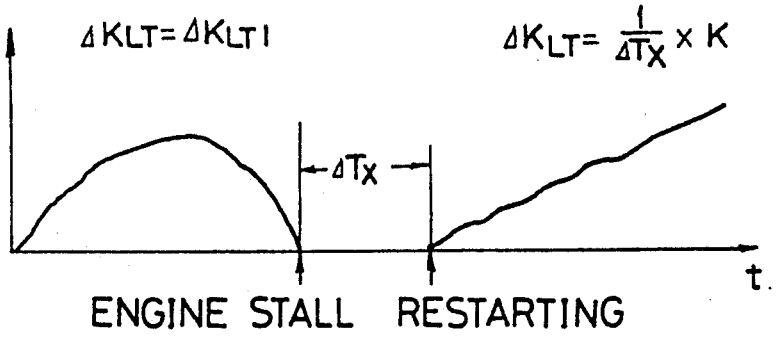
FIG. 7 is a time chart explaining time factor setting process according to another embodiment.
Figure 9:
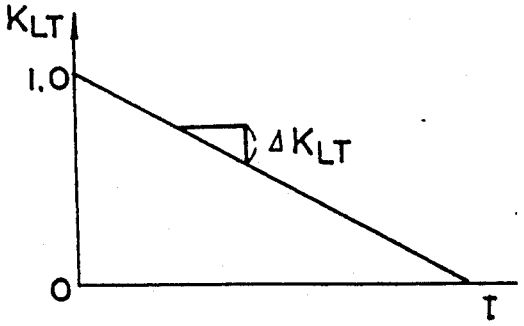
Fig. 9 PRIOR ART
FIG. 9 is a characteristic diagram showing a time factor setting technique according to a prior art.

In this case, the second subtrahend $\Delta K_{LT2}$ corresponding to the engine stall period $\Delta T_X$ shown in FIG. 7 is calculated according to the following equation:

$$\Delta K_{LT2}=(1/\Delta T_X)\times K$$

where K is a matching value.

Figure 8:
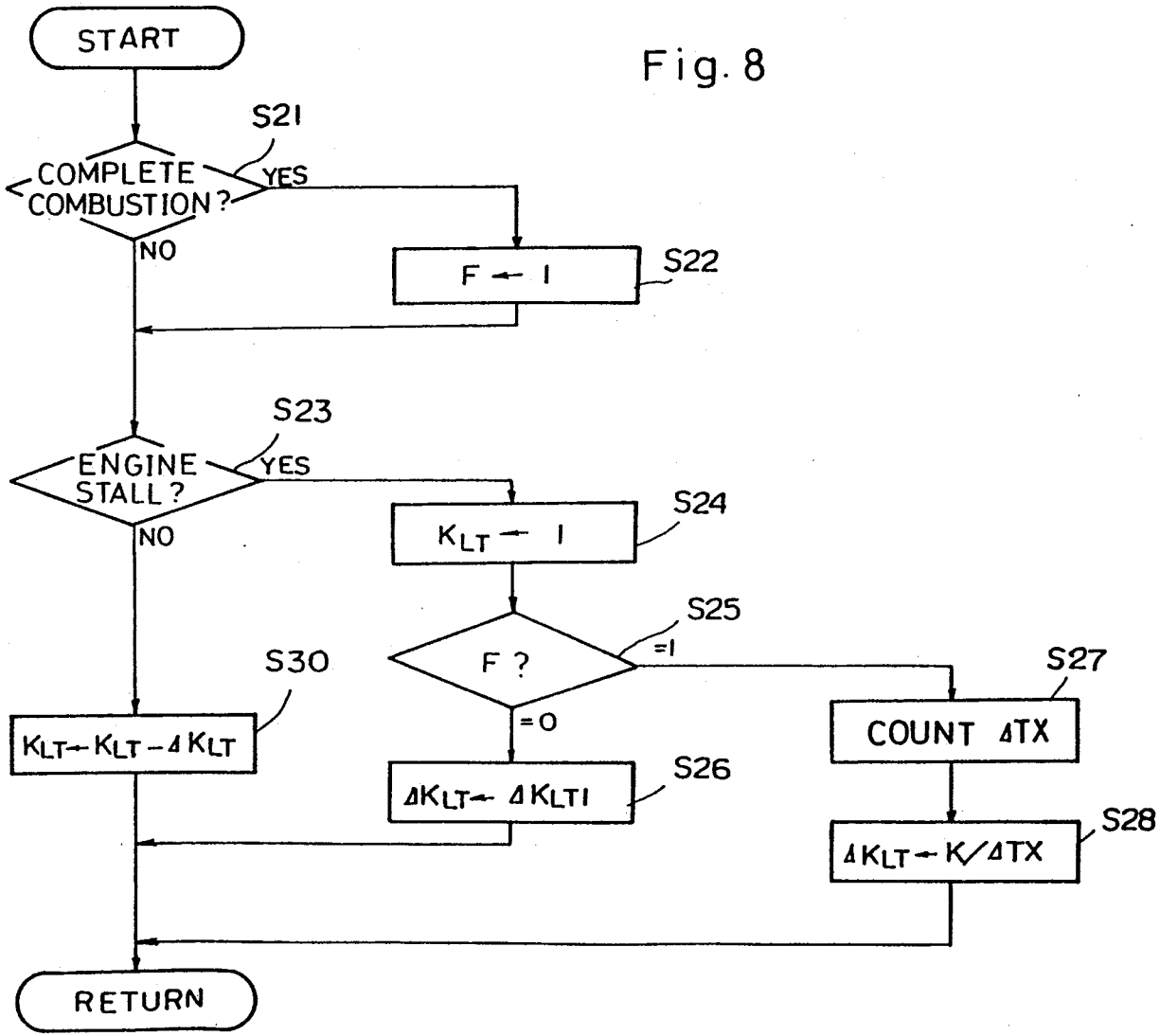
FIG. 8 is a flowchart showing the time factor setting routine according to the another embodiment.
Figure 10:
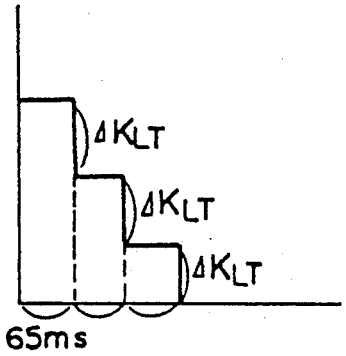
Fig.10 PRIOR ART
FIGS. 10 and 11 are time charts showing the time factor setting technique according to the prior art.
Figure 11:
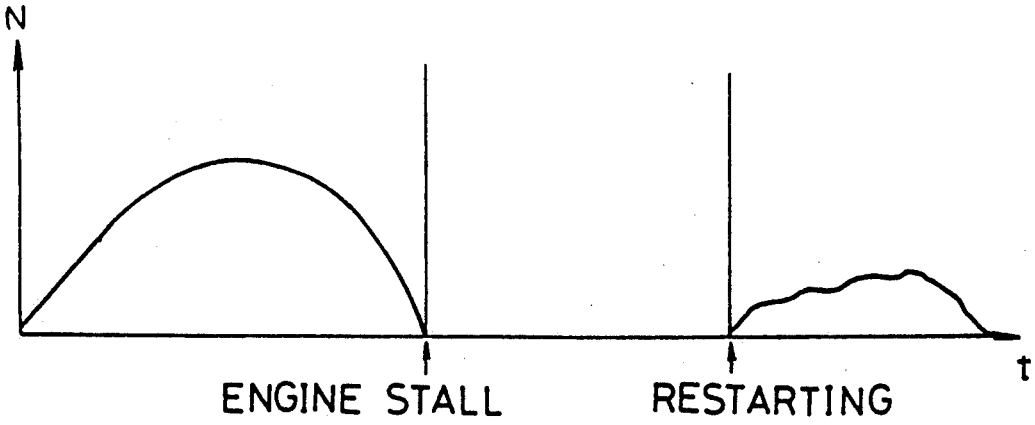
Fig.11 PRIOR ART

A routine of this embodiment for setting the time factor is shown in a flowchart of FIG. 8. Steps 21 to 26, and 30 of this embodiment correspond to steps 11 to 16, and 18 of FIG. 5. Steps 25 and 28 are peculiar to this embodiment.

Step 25 judges whether or not the flag (F) is set to 1. If the flag (F) is not set to 1, step 26 selects the first subtrahend $\Delta K_{LT1}$ as the $\Delta K_{LT}$. If the flag (F) is set to 1, step 27 counts $\Delta T_X$, and step 28 calculates $\Delta K_{LT2}=(1/\Delta T_X)\times K$ to set the second subtrahend $\Delta K_{LT2}$.

This embodiment increases the second subtrahend $\Delta K_{LT2}$ when the engine stall period $\Delta T_X$ is short, and decreases the second subtrahend $\Delta K_{LT2}$ when the engine stall period $\Delta T_X$ is long, thereby optimally adjusting the second subtrahend $\Delta K_{LT2}$ according to the engine stall period $\Delta T_X$. This arrangement provides an optimum fuel injection quantity matching with a required fuel injection quantity, thereby securely restarting the engine and improving starting operation of the engine as shown in FIG. 7.

As described above, the fuel injection quantity control system for starting the two-cycle engine according to the present invention employs two subtrahend setting means for setting a subtrahend to be applied to a time factor. To restart the engine, the subtrahend which is larger than the subtrahend being selected for starting the engine for the first time is set, thereby the actual fuel injection quantity will not exceed the required fuel injection quantity. The optimal fuel injection quantity for starting the engine can be selected, the restarting operation can surely drive the engine, and further the starting performance can be improved.

Industrial Application Field

The fuel injection quantity control system according to the embodiments of the invention is particularly applicable for starting two-cycle engines such as snowmobiles. Snowmobiles, etc. will benefit greatly from such an invention by being able to operate safely and continuously on snowy road conditions.

We claim:

1. A fuel injection quantity control system for starting a two-cycle engine, having a fuel injection valve, a means for correcting a basic fuel injection quantity stored in advance by the engine temperature depending on cranking speed and a means for correcting the basic fuel injection quantity depending on cranking time comprising as a means for correcting said basic injection quantity depending on cranking time:

a time factor setting means for updating and setting, at predetermined intervals, a time factor suitable to the cranking time by subtracting a predetermined subtrahend from a last time factor;

a first subtrahend setting means for setting a first subtrahend to be applied to the time factor at a first engine start;

a start judging means for judging, when an engine start is detected, whether it is a second or later engine start; and a second subtrahend setting means for setting a second subtrahend to be applied to the time factor which is larger than the first subtrahend when the second or later engine start is judged by said start judging means.

2. A fuel injection quantity control system for starting a two-cycle engine as set forth in claim 1, wherein the second subtrahend setting means sets a second subtrahend according to a period of time from a first engine start to restarting.

3. A fuel injection quantity control system for starting two-cycle engine as set forth in claim 2, wherein the second subtrahend setting means sets a second subtrahend $\Delta K_{LT2}$ according to a period of time $\Delta T_X$ from an engine stalling in a first engine starting to restarting according to the following equation:

$$\Delta K_{LT2}=(1/\Delta T_X)\times K$$

where K is a matching value.

* * * * *